US008561651B2

(12) United States Patent
Watanabe et al.

(10) Patent No.: US 8,561,651 B2
(45) Date of Patent: Oct. 22, 2013

(54) FABRIC, FABRIC MANUFACTURING METHOD AND VEHICLE SEAT

(75) Inventors: Kazunori Watanabe, Toyota (JP); Satoru Yamada, Tajimi (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 48 days.

(21) Appl. No.: 13/455,388

(22) Filed: Apr. 25, 2012

(65) Prior Publication Data

US 2012/0273086 A1 Nov. 1, 2012

(30) Foreign Application Priority Data

Apr. 27, 2011 (JP) ..... 2011-100049

(51) Int. Cl.
*D02G 3/42* (2006.01)
*A47C 7/24* (2006.01)

(52) U.S. Cl.
USPC ..... 139/395; 139/393; 139/420 R; 139/421; 139/422; 139/426 R; 297/452.13; 297/451.9

(58) Field of Classification Search
USPC ..... 139/383 R, 393, 395, 420 R, 421, 422, 139/426 R; 297/452.1, 452.13, 451.9
See application file for complete search history.

(56) References Cited

U.S. PATENT DOCUMENTS 3,846,970 A * 11/1974 Hitomi et al. ..... 57/246
4,000,342 A * 12/1976 Rochelle et al. ..... 428/88
4,352,380 A * 10/1982 Owen et al. ..... 139/426 R
4,517,715 A * 5/1985 Yoshida et al. ..... 28/144
5,223,198 A * 6/1993 Frankfort et al. ..... 264/103
5,428,969 A * 7/1995 Day et al. ..... 66/202
2002/0032955 A1* 3/2002 Rasnick et al. ..... 28/103
2002/0045395 A1* 4/2002 Lintecum et al. ..... 442/304
2002/0155775 A1* 10/2002 Capel ..... 442/263
2003/0005682 A1* 1/2003 Jen ..... 57/289
2003/0029152 A1* 2/2003 Schaad ..... 57/90
2003/0139109 A1* 7/2003 Johnson et al. ..... 442/149
2003/0177749 A1* 9/2003 Jen ..... 57/289
2003/0187140 A1* 10/2003 Lintecum et al. ..... 525/178
2003/0221298 A1* 12/2003 Murayama et al. ..... 24/445
2003/0232557 A1* 12/2003 Korfer ..... 442/295
2004/0069402 A1* 4/2004 Zafiroglu ..... 156/256
2004/0097151 A1* 5/2004 McMurray ..... 442/304
2004/0124689 A1* 7/2004 Numa et al. ..... 297/452.56
2004/0129334 A1* 7/2004 Salway et al. ..... 139/407
2005/0070188 A1* 3/2005 Schindler et al. ..... 442/197
2005/0158543 A1* 7/2005 Lee et al. ..... 428/373
2006/0207077 A1* 9/2006 Holmberg ..... 28/144
2010/0051132 A1* 3/2010 Glenn ..... 139/387 R
2010/0227109 A1* 9/2010 Susa et al. ..... 428/90

FOREIGN PATENT DOCUMENTS

JP 2004-135707 5/2004

* cited by examiner

*Primary Examiner* — Bobby Muromoto, Jr.
(74) *Attorney, Agent, or Firm* — Greenblum & Bernstein, P.L.C.

(57) ABSTRACT

A fabric, a fabric manufacturing method and a vehicle seat are provided. The fabric has one surface and an opposite surface, and includes a constituent yarn having at least an elastic yarn; and a chenille yarn having a core yarn and a pile yarn. At least one kind of yarn of the constituent yarn is shaped in a waveform as seen from a sectional direction of the fabric. The core yarn is located closer to the opposite surface than an imaginary line, the imaginary line being formed by connecting each of peaks of mountain portions of the waveform in the one surface.

6 Claims, 2 Drawing Sheets

FABRIC, FABRIC MANUFACTURING METHOD AND VEHICLE SEAT

BACKGROUND OF THE INVENTION

1. Field of the Invention

The present invention relates to a fabric, a fabric manufacturing method and a vehicle seat.

2. Description of the Related Art

There has been known a fabric having an elastic yarn which is used as a seat skin, and the like. Such a fabric has a good stretching property (elasticity) and is capable of equally dispersing the body pressure of the seated person, even without a foamed urethane which is normally disposed at an interior of the seat skin or even in a case of having a thin thickness. Consequently, the seated person can be supported without compromising a seating comfort.

However, a rigid monofilament is generally used as the elastic yarn, so that surface feeling thereof is coarse and rigid. Therefore, there is known a seat in which a fabric using a chenille yarn as a portion of a textile to improve the texture thereof is covered with a skin material (see, JP 2004-135707 A).

In a fabric having an elastic yarn and a chenille yarn used in a related-art skin material, the elastic yarn is shrunk by a heat treatment in order to provide a stretch. At this time, there is caused a shrinkage difference between the elastic yarn and another constituent yarn such as the chenille yarn and thus the chenille yarn having a shrinkage level smaller than the elastic yarn is raised (protrudes). Accordingly, there is a problem that the chenille yarn is damaged and cut out due to a load or a friction caused by getting on and off or seating of the seated person. Specifically, as illustrated in FIG. 3, the chenille yarn 3 is typically constituted by a plurality of core yarns 31 and a plurality of pile (flower) yarns 32 sandwiched between the core yarns 31, and the core yarns 31 are directly damaged and cut out by the friction mentioned above. Accordingly, there occurs a problem that the pile yarns 32 sandwiched between the core yarns 31 are separated away.

SUMMARY OF THE INVENTION

The present invention has been made in view of the above circumstances, and an aspect of the present invention is to provide a fabric, a fabric manufacturing method and a vehicle seat which can sufficiently suppress a frictional effect to a core yarn constituting a chenille yarn and have good wear resistance.

According to an illustrative embodiment of the present invention, there is provided a fabric having one surface and an opposite surface, the fabric comprising: a constituent yarn having at least an elastic yarn; and a chenille yarn having a core yarn and a pile yarn. At least one kind of yarn of the constituent yarn is shaped in a waveform as seen from a sectional direction of the fabric, and the core yarn is located closer to the opposite surface than an imaginary line, the imaginary line being formed by connecting each of peaks of mountain portions of the waveform in the one surface.

According to another illustrative embodiment of the present invention, there is provided a fabric manufacturing method comprising: forming a raw fabric by using a chenille yarn including a core yarn and a pile yarn, and at least two constituent yarns having different thermal shrinkage; and performing thermally treatment to the raw fabric to obtain a fabric having one surface and an opposite surface. At least one of the constituent yarns is an elastic yarn, at least one kind of yarn of the constituent yarn is shaped in a waveform as seen from a sectional direction of the fabric, and the core yarn is located closer to the opposite surface than an imaginary line, the imaginary line being formed by connecting each of peaks of mountain portions of the waveform in the one surface According to a further illustrative embodiment of the present invention, there is provided a vehicle seat using the above fabric.

According to the above fabric, at least one kind of yarn of the constituent yarn is shaped in a waveform as seen from a sectional direction of the fabric and the core yarn is located closer to the opposite surface than an imaginary line formed by connecting each of peaks of mountain portions of the waveform in the one surface side. Accordingly, it is possible to sufficiently suppress a frictional effect to the core yarn constituting the chenille yarn and to provide good wear resistance to the fabric.

According to the above fabric manufacturing method, a fabric which can sufficiently suppress a frictional effect to the core yarn constituting the chenille yarn and has good wear resistance can be easily manufactured.

According to the above vehicle seat, the fabric which can sufficiently suppress a frictional effect to the core yarn constituting the chenille yarn and has good wear resistance is used as a material. Accordingly, the vehicle seat has excellent durability.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

The matters presented herein are provided for illustratively explaining the illustrative embodiments of the present invention and serves to effectively explain the principle and conceptual features of the present invention. In this regard, it is apparent to those skilled in the art that the structural characteristics of the present invention are not limited by such a detailed description and the present invention can be realized in various illustrative embodiments by referring to the accompanying drawings.

1. Fabric

The fabric according to the illustrative embodiment 1 provides a fabric which includes a constituent yarn having at least an elastic yarn, and a chenille yarn having a core yarn and a pile yarn. The fabric includes one surface and an opposite surface. At least one kind of yarn of the constituent yarn is shaped in a waveform as seen from a sectional direction of the fabric. The core yarn is located closer to the opposite surface than an imaginary line formed by connecting each of peaks of mountain portions of the waveform in the one surface.

Figure 1:
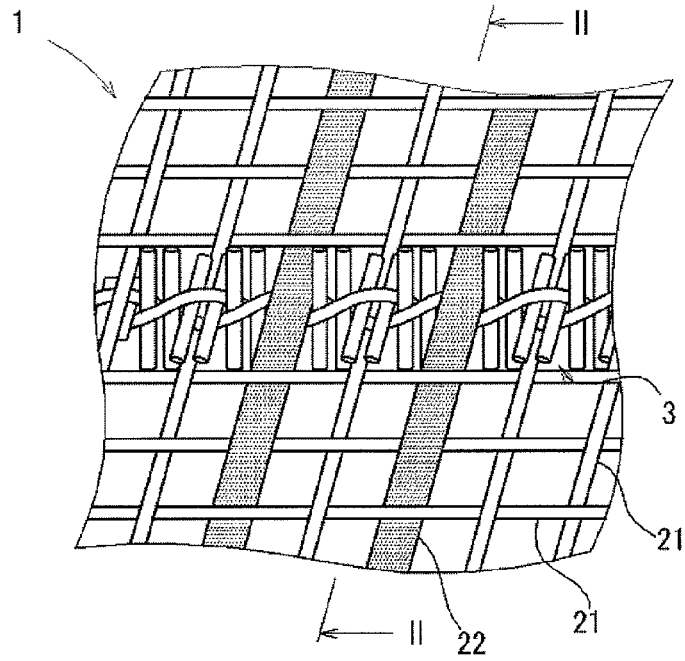
FIG. 1 is a schematic view for explaining a fabric according to an illustrative embodiment of the present invention.
Figure 2:
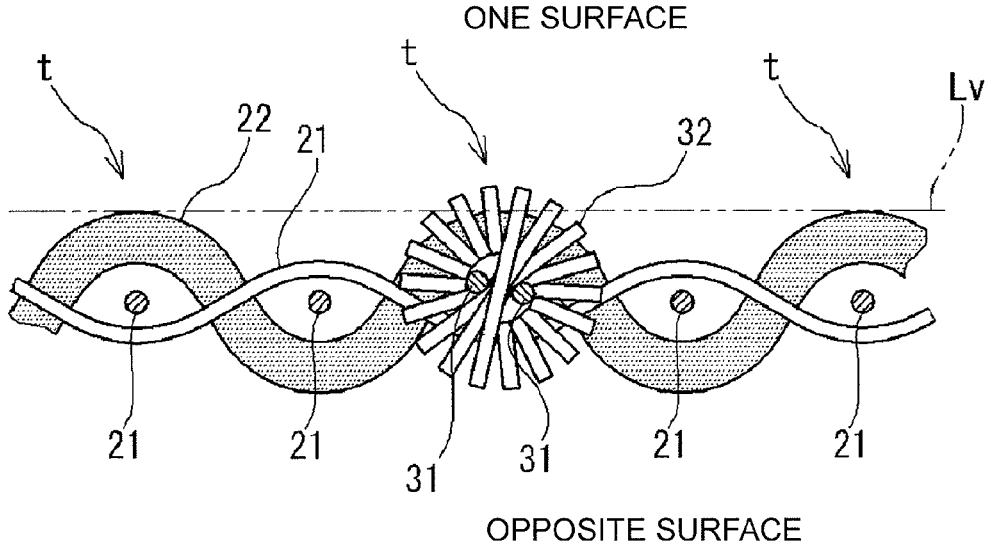
FIG. 2 is a schematic sectional view taken along line II-II in the fabric of FIG. 1.

Specifically, in the fabric illustrated in FIG. 2, at least one yarn 22 of the constituent yarn 21, 22 is shaped in a waveform as seen from a sectional direction (see, a sectional view taken along line II-II of FIG. 1) of the fabric, and the core yarn 31 constituting the chenille yarn 3 is located closer to the opposite surface than an imaginary line Lv formed by connecting each of peaks t of mountain portions of the waveform in the one surface.

The "constituent yarn" may be used in any one of the warp and the weft constituting the fabric or may be used in both the warp and the weft.

At least one kind of yarn of the constituent yarn is an elastic yarn. Further, it may be preferred that a protective yarn is used as the constituent yarn. In this case, it is possible to more securely suppress a frictional effect to the core yarn constituting the chenille yarn and to further improve wear resistance thereof.

Material of the "elastic yarn" is not particularly limited. For example, the elastic yarn can be obtained by using a polyurethane fiber, a polyetherester fiber, a polyamide fiber, a polytrimethyleneterephthalate (PTT) fiber, or the like. The form of the elastic yarn is not particularly limited. For example, a straight yarn or a crimped textured yarn may be used. Further, the elastic yarn may be a monofilament or a multifilament. Furthermore, the sectional shape of the elastic yarn is not particularly limited. Among them, from the viewpoint of obtaining a suitable elongation and a good elongation recovery, a polytrimethyleneterephthalate monofilament type may be preferred.

The fineness of the elastic yarn is not particularly limited. For example, the fineness of the elastic yarn may be preferably in a range of 30 to 10000 dtex, and more preferably in a range of 50 to 2000 dtex.

The elongation modulus (10% elongation) of the elastic yarn may be preferably in a range of 80 to 100%, and more preferably in a range of 90 to 100%. Further, the elongation modulus can be measured by stretching the elastic yarn up to 10% elongation by using JIS L1013 8.9b) B method.

The thermal shrinkage of the elastic yarn may be preferably in a range of 5 to 30%, and more preferably in a range of 10 to 20%. Further, the thermal shrinkage can be measured by applying an initial load 8.82 (mN)×10×a designation dtex to the elastic yarn, making a small hank with a hank length 50 cm and number of turns 5, releasing the load and then heating the elastic yarn at 180° C. for 90 sec, applying the initial load to the elastic yarn, measuring the hank length and by calculating a formula [(50−l)/50]×100 (herein, the symbol l indicates a length (cm) after thermally treating the elastic yarn at 180° C. for 90 sec).

It may be preferred that the "protective yarn" have mechanical strength higher than that of the elastic yarn. Specifically, it may be preferred that the protective yarn has tensile strength higher than that of the elastic yarn.

Material of the protective yarn is not particularly limited. For example, the protective yarn can be obtained by using a polyester fiber, a polyamide fiber, etc. The form of the protective yarn is not particularly limited. For example, a straight yarn or a crimped textured yarn may be used. Further, the protective yarn may be a monofilament or a multifilament. Furthermore, the sectional shape of the protective yarn is not particularly limited.

The tensile strength of the protective yarn can be evaluated by "strength at break" in JIS L1013 8.5.1 standard test and measured by using a constant speed elongation testing machine while setting the grasp intervals in 25 (cm) and the tensile speed in 30 (cm/min). This measured value may be preferably equal to or larger than 10 N, and more preferably equal to or larger than 50 N.

The fineness of the protective yarn is not particularly limited and the larger may be preferable. Specifically, the fineness of the protective yarn may be preferably equal to or larger than 100 dtex, more preferably equal to or larger than 500 dtex, and most preferably equal to or larger than 1000 dtex. In a case where the fineness of the protective yarn is equal to or larger than 100 dtex, it is possible to more securely suppress a frictional effect to the core yarn and to further improve wear resistance thereof.

The thermal shrinkage of the protective yarn may be preferably lower than that of the elastic yarn. The thermal shrinkage of the protective yarn may be preferably in a range of 0 to 20%, more preferably in a range of 0 to 10%. Further, the thermal shrinkage of the protective yarn can be measured similarly as in the elastic yarn mentioned above.

Further, in the fabric according to the illustrative embodiment 1, the constituent yarn includes the elastic yarn and the protective yarn, and a value obtained by calculating the following formula (1) is in a range of 5 to 50. In a case where the value is in a range of 5 to 50, it is possible to more securely suppress a frictional effect to the core yarn and to further improve wear resistance thereof.

$$[(L_1-L_2)/L_2]\times 100 \quad (1)$$

Herein, $L_1$ (mm) indicates a length of the protective yarn and $L_2$ (mm) indicates a length of the elastic yarn.

Further, the length of each yarn in the formula (1) indicates a length of each yarn constituting a square test specimen (one side: 100 mm) obtained by cutting the fabric according to the present embodiment. Herein, the test specimen is obtained by cutting the fabric in a direction parallel to a woven direction of the warp or the weft constituting the fabric.

Figure 3:
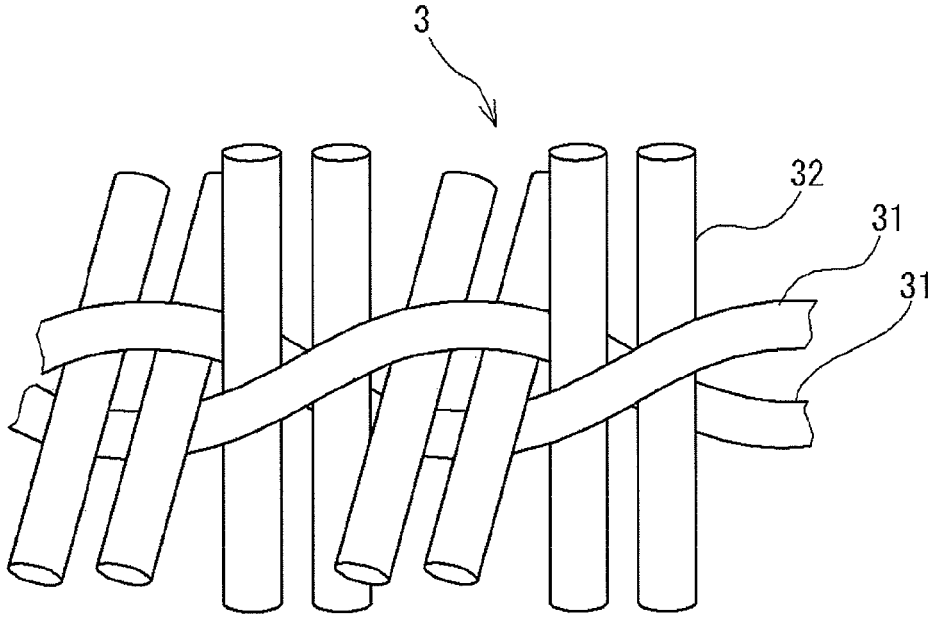
FIG. 3 is a schematic view for explaining a chenille yarn.

The "chenille yarn" may be used in any one of the warp and the weft constituting the fabric or may be used in both the warp and the weft. Typically, the chenille yarn includes a plurality of core yarns 31 and a plurality of pile yarn 32 sandwiched between the core yarns 31 (see, FIG. 3).

Material of the "core yarn" is not particularly limited. For example, the core yarn can be obtained by using a polyamide fiber, a polyester based fiber, or the like. Among them, from the viewpoint of firmly holding the pile yarns between the core yarns, the core yarns are preferably thermally fused to the pile yarn or another core yarn. The form of the core yarn is not particularly limited. For example, a straight yarn or a crimped textured yarn may be used. Further, the core yarn may be a monofilament or a multifilament. Among them, the multifilament is preferable. Furthermore, the sectional shape of the core yarn is not particularly limited.

The fineness of the core yarn is not particularly limited. For example, the fineness of the core yarn may be preferably in a range of 30 to 10000 dtex, and more preferably in a range of 100 to 500 dtex.

As the "pile yarn", a filament yarn may be used, for example. The form of the pile yarn is not particularly limited. For example, a straight yarn or a crimped textured yarn may be used. Further, the pile yarn may be a monofilament or a multifilament. Furthermore, the sectional shape of the pile yarn is not particularly limited.

The fineness of the pile yarn is not particularly limited. For example, the fineness of the pile yarn may be preferably in a range of 30 to 300 dtex, and more preferably in a range of 50 to 100 dtex.

Further, the texture or the arrangement of the yarn in the fabric according to the illustrative embodiment 1 is not particularly limited. For example, texture such as a plain weave, a twill weave and a sateen weave may be employed. Further, density and basis weight of the fabric is not particularly limited and any weaving parameters can be employed depending upon the applications, or the like. In particular, in the fabric according to the illustrative embodiment 1, the warp includes at least the constituent yarn and the weft includes at least the chenille yarn.

2. Fabric Manufacturing Method

The fabric manufacturing method according to an illustrative embodiment 2 includes: a raw fabric forming step of forming a raw fabric by using a chenille yarn including a core yarn and a pile yarn, and at least two constituent yarns having different thermal shrinkage; and a heat treating step of performing thermal treatment to the raw fabric, wherein at least one of the constituent yarns is an elastic yarn.

In the "raw fabric forming step", the raw fabric is formed by using a chenille yarn having a core yarn and a pile yarn, and at least two constituent yarns having different thermal shrinkage.

Herein, the texture or the arrangement of the raw fabric is not particularly limited. Further, it may be preferred that the protective yarn is used as the "constituent yarn," in addition to the "elastic yarn." In addition, regarding to the chenille yarn and the constituent yarn (elastic yarn, protective yarn), the description in the fabric according to the illustrative embodiment 1 can be similarly applied.

In the "heat treating step," the raw fabric obtained at the raw fabric forming step is thermally treated. Parameters of the heat treating step can be suitably adjusted depending upon the type of the yarn constituting the fabric, or the like. For example, a heating temperature may be in a range of 130 to 190° C. (in particular, 150 to 180° C.). Further, a heating time may be in a range of 1 to 5 minutes (in particular, 1 to 2 minutes).

In particular, in the fabric manufacturing method according to the illustrative embodiment 2, an elastic yarn and a protective yarn having a thermal shrinkage lower than the elastic yarn may be preferably used as the constituent yarn. Further, in the heat treating step, it may be preferred to cause the elastic yarn to be shrunk. In addition, each of the constituent yarns can be thermally treated in advance prior to performing the raw fabric forming step. By doing so, it is possible to adjust the thermal shrinkage in the heat treating step.

According to the fabric manufacturing method of the illustrative embodiment 2, by utilizing the shrinkage difference between the constituent yarns, it is possible to manufacture the fabric in which at least one yarn 22 is shaped in a waveform as seen from a sectional direction (see, a sectional view taken along line II-II of FIG. 1) of the fabric 1 and the core yarn 31 is located closer to the opposite surface than an imaginary line Lv formed by connecting each of peaks t of mountain portions of the waveform in the one surface, as illustrated in FIG. 2. Accordingly, it is possible to sufficiently suppress a frictional effect to the core yarn constituting the chenille yarn and to provide good wear resistance to the fabric.

3. Vehicle Seat

A vehicle seat according to an illustrative embodiment 3 is formed by using the fabric according to the illustrative embodiment 1.

Since the fabric can sufficiently suppress a frictional effect to the core yarn constituting the chenille yarn and has good wear resistance, a vehicle seat having excellent durability can be obtained. Furthermore, it is possible to obtain a vehicle seat having an elongation and a frictional force suitable for holding the seated person by the presence of the elastic yarn and the chenille yarn in the fabric.

Further, in the vehicle seat according to the illustrative embodiment 3, it may be preferred that the one surface [a surface in which the imaginary line Lv of FIG. 2 is defined] of the fabric is used as a front surface.

EXAMPLES

Hereinafter, illustrative embodiment of the present invention will be described in detail by referring to examples.

Example 1 and 2

[1-1] Manufacture of Fabric

Each of the fabric according to examples 1 and 2 was obtained by forming a raw fabric using an elastic yarn and a protective yarn as the warp and a chenille yarn and the elastic yarn as the weft and then thermally treating the obtained fabric (heating temperature: 180° C., heating time: 2 minutes).

Further, details of the yarns and weaving parameters used in each example are as follows.

Detail of Yarns Used in Example 1

<The Warp>

(1) Elastic yarn: PTT monofilament (80 dtex), tensile strength (strength at break): 2 N, and thermal shrinkage (temperature: 180° C.): 15%

(2) Protective yarn (high tenacity yarn): Part No. "702C" [Polyester filament (560 dtex/96 filament) two-folded yarn, twisted number: 180 (windings/m), twisted direction: Z, tensile strength (strength at break): 82 N] which is available from TORAY INDUSTRIES INC.

<The Weft>

(1) Chenille yarn: ¼. 2 count of yarn, PET yarn dyeing chenille type, core yarn [material: PET, fineness: 280 dtex two-folded yarns, twisted number: 900 (windings/m), twisted direction: Z], pile yarn (material: PET, fineness: 84 dtex)

(2) Elastic yarn: PTT monofilament (110 dtex), fusion type, tensile strength (strength at break): 2.5 N, thermal shrinkage (temperature: 180° C.): 15%

Detail of Yarns Used in Example 2

<The Warp>

(1) Elastic yarn: "DIAFLORA" [Polyester based elastomeric monofilament (330 dtex), tensile strength (strength at break): 10 N, thermal shrinkage (temperature: 180° C.): 30%] which is available from TOYOBO CO., LTD.

(2) Protective yarn: manufactured by REC Corporation, Polyester yarn (660 dtex/70 filament) two-folded yarn, twisted number: 180 (windings/m), twisted direction: Z, tensile strength (strength at break): 50 N].

<The Weft>

(1) Chenille yarn: ¼. 2 count of yarn, PET yarn dyeing chenille type, core yarn [material: PET, fineness: 280 dtex two-folded yarns, twisted number: 900 (windings/m), twisted direction: Z], pile yarn (material: PET, fineness: 84 dtex)

(2) Elastic yarn: "DIAFLORA" [Polyester based elastomeric monofilament (500 dtex), tensile strength (strength at break): 13 N, thermal shrinkage (temperature: 180° C.): 30%] which is available from TOYOBO CO., LTD.

Weaving Parameters in Examples 1 and 2

<Weaving Parameters>

Arrangement of the warp: (1)×11 and (2)×3

Arrangement of the weft: (1)×1 and (2)×9

Texture: Plain Weave

Total number of the warp: 6944 strands

Width through: 62 in (1575 mm)

Warp densities (reed number/width through): 16 reeds, 7 strands

Weft setting densities: 70 strands/in

Using loom: Dobirepia

[1-2] Configuration of Fabric

The fabric 1 of examples 1 and 2 thus obtained includes the elastic yarn (constituent yarn) 21, the protective yarn (constituent yarn) 22, and the chenille yarn 3. Further, the pile yarn 32 of the chenille yarn 3 protrudes beyond the peak of the elastic yarn 21 in one surface to give a good tactile sensation. Accordingly, the thickness sensation of the fabric can be presented. As illustrated in FIG. 2, the protective yarn 22 as one kind of the constituent yarn is shaped in a waveform as seen from a sectional direction (see, a sectional view taken along line II-II of FIG. 1) of the fabric and the core yarn 31 constituting the chenille yarn is located closer to the opposite surface than an imaginary line Lv formed by connecting each of peaks t of mountain portions of the waveform in the one surface.

Further, the values indicated by the following formula (1) are respectively 12 (example 1) and 30 (example 2) in a case where a square test specimen (one side: 100 mm) is obtained by cutting each fabric.

$$[(L_1-L_2)/L_2]\times 100 \quad (1)$$

Herein, $L_1$ (mm) indicates a length of the protective yarn and $L_2$ (mm) indicates a length of the elastic yarn.

[1-3] Mechanical Properties of the Fabric According to Examples 1 and 2[Wear Resistance Properties]

Each of the fabrics according to examples 1 and 2 was used to prepare a test specimen (130 mm diameter circular test specimen) and then the wear resistance properties thereof were evaluated in accordance with Taber Abrasion test [JIS L1096.8.19.3 C method (Taber type method)]. Further, in this test, one surface, at a side on which the imaginary line Lv is formed, of the test specimen is brought into contact with a wear wheel.

<Test Conditions>

Tester: "TABER ABRASION TESTER", available from TOYO SEIKI SEISAKU-SHO, LTD.

Wear wheel: CS-10

Load: 4.9 N

Number of rotations: 1000 rotations

<Evaluation Criteria>

The test specimen after the test was checked by a visual inspection and then evaluated according to the following criteria. Herein, the grade equal to or higher than grade 3 is considered as a good product.

grade 5: No change in state.

grade 4: Occurrence of small amount of fuzz.

grade 3: Occurrence of large amount of fuzz.

grade 2: Occurrence of large amount of fuzz and thinner yarn.

grade 1: Occurrence of yarn breakage.

As a result, the wear resistance properties of the fabric according to examples 1 and 2 in which the core yarn 31 constituting the chenille yarn 3 is located closer to the opposite surface than an imaginary line Lv were evaluated as grade 3. That is, it was found that the fabric according to examples 1 and 2 had excellent durability.

Comparative Example 1

[2-1] Manufacture of Fabric

Fabric according to a comparative example 1 was obtained by forming a raw fabric using an elastic yarn as the warp and a chenille yarn and the elastic yarn as the weft and then thermally treating the obtained raw fabric (heating temperature: 180° C., heating time: 2 minutes). And then, the wear resistance properties of the fabric according to the comparative example 1 were evaluated in same manner as in Example 1.

Further, details of the yarns and weaving conditions used in comparative example are as follows.

<The Warp>

(1) Elastic yarn: "DIAFLORA" [Polyester based elastomeric monofilament (330 dtex), tensile strength (strength at break): 10 N, thermal shrinkage (temperature: 180° C.): 30%] which is available from TOYOBO CO., LTD.

<The Weft>

(1) Chenille yarn: ¼. 2 count of yarn, PET yarn dyeing chenille type, core yarn [material: PET, fineness: 280 dtex two-folded yarns, twisted number: 900 (windings/m), twisted direction: Z], pile yarn (material: PET, fineness: 84 dtex)

(2) Elastic yarn: "DIAFLORA" [Polyester based elastomeric monofilament (500 dtex), tensile strength (strength at break): 13 N, thermal shrinkage (temperature: 180° C.): 30%] which is available from TOYOBO CO., LTD.

<Weaving Parameters>

Arrangement of the warp: (1) only

Arrangement of the weft: (1)×1 and (2)×4

Texture: Plain Weave

Total number of the warp: 6944 strands

Width through: 62 in (1575 mm)

Warp densities (reed number/width through): 16 reeds, 7 strands

Weft setting densities: 60 strands/in

Using loom: Dobirepia

Figure 4:
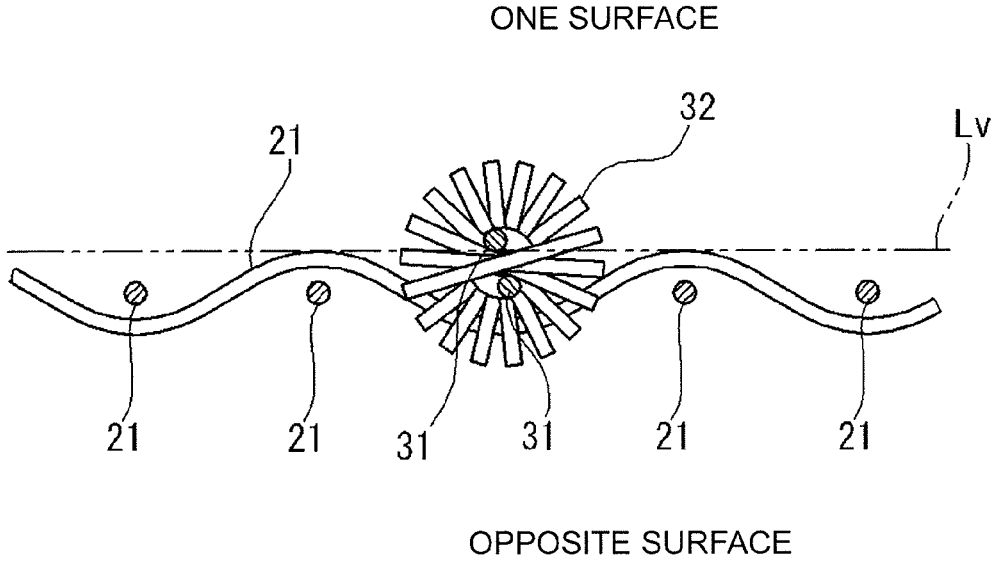
FIG. 4 is a schematic view for explaining a fabric according to a comparative example 1.

As illustrated in FIG. 4, in the fabric according to the comparative example 1, there are locations where the core yarn 31 in the chenille yarn is located closer to the one surface than the imaginary line Lv. And, the core yarns located closer to the one surface than the imaginary line Lv are subjected to damage. Consequently, the wear resistance property of the fabric according to the comparative example 1 was evaluated as grade 1. That is, it was found that the fabric according to comparative example 1 has no sufficient durability.

The above illustrative embodiments are presented to be illustrative only and are not intended to limit the scope of the present invention. Although the representative embodiments of the present invention are illustrated as an example, it is understood that the terminology used herein is for the purpose of describing particular illustrative embodiments only and is not intended to limit the present invention. As is illustrated in detail herein, the present invention can be variously changed without departing from the spirit and scope of the present invention while falling within the range defined by the appended claim. Herein, although a specific structure, material and embodiment of the present invention are illustrated as an example, the scope of the present invention is only defined by the appended claims and equivalents thereof.

The present invention is not limited to the embodiments described in detail hereinabove and may be variously modified without departing from the scope of the invention defined by the appended claim.

The fabric, the fabric manufacturing method and the vehicle seat of the present invention can be widely applied in a vehicle related field such as an automobile, a vessel related field, an aircraft related field, a construction related field, a furniture related field, etc.

What is claimed is:

1. A fabric having one surface and an opposite surface, the fabric comprising:

at least two constituent yarns having different thermal shrinkage; and a chenille yarn having a core yarn and a pile yarn, wherein at least one kind of yarn of the at least two constituent yarns is shaped in a waveform as seen from a sectional direction of the fabric, and wherein the core yarn is located closer to the opposite surface of the fabric than a line that connects peaks of mountain portions of the waveform in the one surface of the fabric.

2. The fabric according to claim 1, wherein the at least two constituent yarns include a protective yarn and an elastic yarn.

3. The fabric according to claim 1, wherein the at least two constituent yarns are configured by an elastic yarn and a protective yarn, wherein a value obtained by the following formula (1) ranges from 5 to 50, $$[(L_1-L_2)/L_2]\times 100 \quad (1)$$

where $L_1$ (mm) indicates a length of the protective yarn and $L_2$ (mm) indicates a length of the elastic yarn.

4. The fabric according to claim 2, wherein a fineness of the protective yarn is equal to or greater than 100 dtex.

5. A fabric manufacturing method comprising:

forming a raw fabric by using a chenille yarn including a core yarn and a pile yarn, and at least two constituent yarns having different thermal shrinkage; and performing a thermal treatment to the raw fabric to obtain a fabric having one surface and an opposite surface, wherein at least one of the at least two constituent yarns is an elastic yarn, wherein at least one kind of yarn of the at least two constituent yarns is shaped in a waveform as seen from a sectional direction of the fabric, and wherein the core yarn is located closer to the opposite surface of the fabric than a line that connects peaks of mountain portions of the waveform in the one surface of the fabric.

6. A vehicle seat using the fabric according to claim 1.

* * * * *